United States Patent [19]

Burke et al.

[11] 4,071,196

[45] Jan. 31, 1978

[54] AEROSOL VALVE TIP AND INSERT ASSEMBLY

[75] Inventors: James E. Burke, Huntington, Conn.; Anthony J. Grzesiak, Burnham, Ill.

[73] Assignee: VCA Corporation, Baton Rouge, La.

[21] Appl. No.: 735,796

[22] Filed: Oct. 26, 1976

Related U.S. Application Data

[63] Continuation of Ser. No. 608,763, Aug. 28, 1975, abandoned.

[51] Int. Cl.[2] ..... B05B 1/34

[52] U.S. Cl. ..... 239/492

[58] Field of Search ..... 239/337, 490–497, 239/573, 579, 601; 222/402.1, 402.21

[56] References Cited

U.S. PATENT DOCUMENTS

| | | | |
|---|---|---|---|
| 2,767,023 | 10/1956 | Venus, Jr. | 239/491 |
| 3,174,692 | 3/1965 | Green | 239/573 X |
| 3,261,557 | 7/1966 | Greenebaum | 239/579 |
| 3,406,911 | 10/1968 | Keeney | 239/490 |
| 3,416,737 | 12/1968 | Venus, Jr. | 239/490 X |
| 3,482,784 | 12/1969 | Webster | 239/493 |
| 3,532,271 | 10/1970 | Polnauer | 239/494 X |
| 3,580,431 | 5/1971 | Kuffer et al. | 222/402.1 |
| 3,625,437 | 12/1971 | Garrigon | 239/492 X |
| 3,838,822 | 10/1974 | Ewald | 239/601 X |
| 3,881,658 | 5/1975 | Greenebaum et al. | 239/492 |

FOREIGN PATENT DOCUMENTS

| | | | |
|---|---|---|---|
| 224,095 | 11/1924 | United Kingdom | 239/493 |

*Primary Examiner*—Evon C. Blunk
*Assistant Examiner*—Andres Kashnikow
*Attorney, Agent, or Firm*—Donald L. Johnson; John F. Sieberth; David L. Ray

[57] ABSTRACT

An aerosol valve tip and insert assembly adapted for use on aerosol dispensers. The tip includes a body having interconnecting channels and an integral actuator post defining an annular recess. An insert having arcuate shaped bosses defining radial feed channels and a swirl chamber on the rear face is received in the annular recess and abuts the post. The tip and insert assembly provides a substantially uniform aerosol spray pattern and droplet size for carbon dioxide, fluorocarbon, and other pressurized spray formulations over a broad range of pressures.

5 Claims, 10 Drawing Figures

AEROSOL VALVE TIP AND INSERT ASSEMBLY

This application is a continuation of application Ser. No. 608,763, filed Aug. 28, 1975, now abandoned.

BACKGROUND OF THE INVENTION

This invention relates to aerosol spray dispensers, and in particular to aerosol spray orifice structures.

Most aerosol dispensers use a fluorocarbon to propel the material to be dispensed. However, fluorocarbons are relatively expensive. In order to reduce the propellant cost, other gases such as carbon dioxide have been proposed as propellants for aerosol dispensers. However, when using gases such as carbon dioxide, the pressure within the aerosol dispenser varies over a much wider range than does the pressure within a dispenser when a fluorocarbon is used. When the aerosol dispenser is first being used, the pressure is high, but it drops to a very low level near the end of use. For example, an initial pressure as high as 85 pounds per square inch (hereinafter abbreviated "psi") may decrease to a level of about 20–25 psi as the last portion of the material being dispensed exits from the aerosol dispenser.

The aerosol valve tips of the prior art generally only operate efficiently in relatively narrow pressure ranges, e.g., from an initial pressure of from about 50 psi to a final pressure of about 20 psi. Furthermore, the aerosol tips of the prior art commonly produce a less efficient or coarser spray than desirable even at high pressure. In general, a finer mist is achieved when the diameter of the exit orifice is reduced, but the minimum size of the exit orifice is limited by molding and assembly considerations.

It would therefore be highly desirable to have a nozzle or an aerosol tip which would operate over a wide pressure range and produce a fine and efficient mist without having an undesirably small exit orifice. The advantages have been realized in the aerosol tip and insert of the present invention.

SUMMARY OF THE INVENTION

In accordance with the invention, there is provided an aerosol valve tip and insert assembly which produces a fine, efficient spray over a wide pressure range, and which can be manufactured without excessive molding difficulties. The tip includes a body having interconnecting channels and an integral actuator post defining an annular recess. The insert is received in the annular recess and has arcuate shaped bosses on the rear face which abut the post to define radial feed channels and a swirl chamber. The insert has an exit orifice, and the ratio of the diameter of the exit orifice to the diameter of the swirl chamber is critical in achieving an efficient, fine spray over a broad pressure range. The ratio of the width of the feed channels to the diameter of the swirl chamber is also critical in achieving efficient spray over a broad pressure range.

Figure 1:
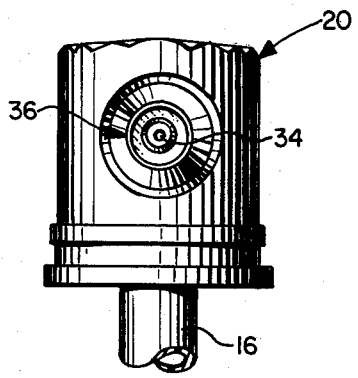
Figure 2:
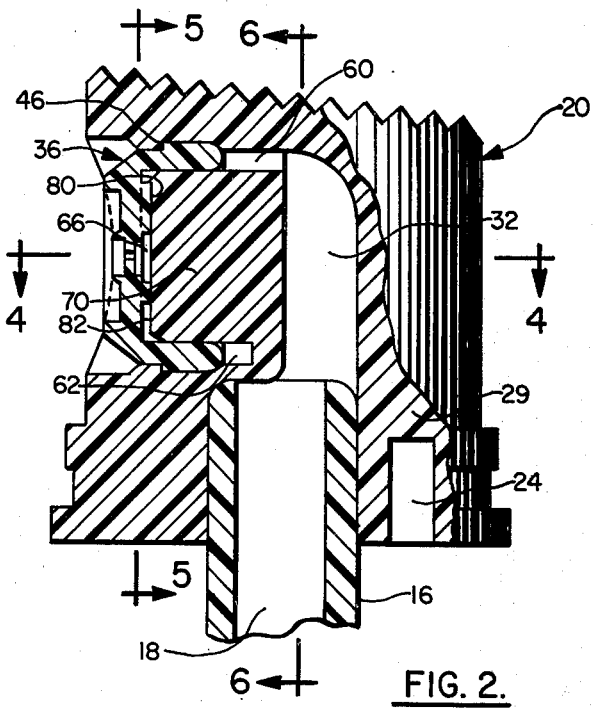
Figure 3:
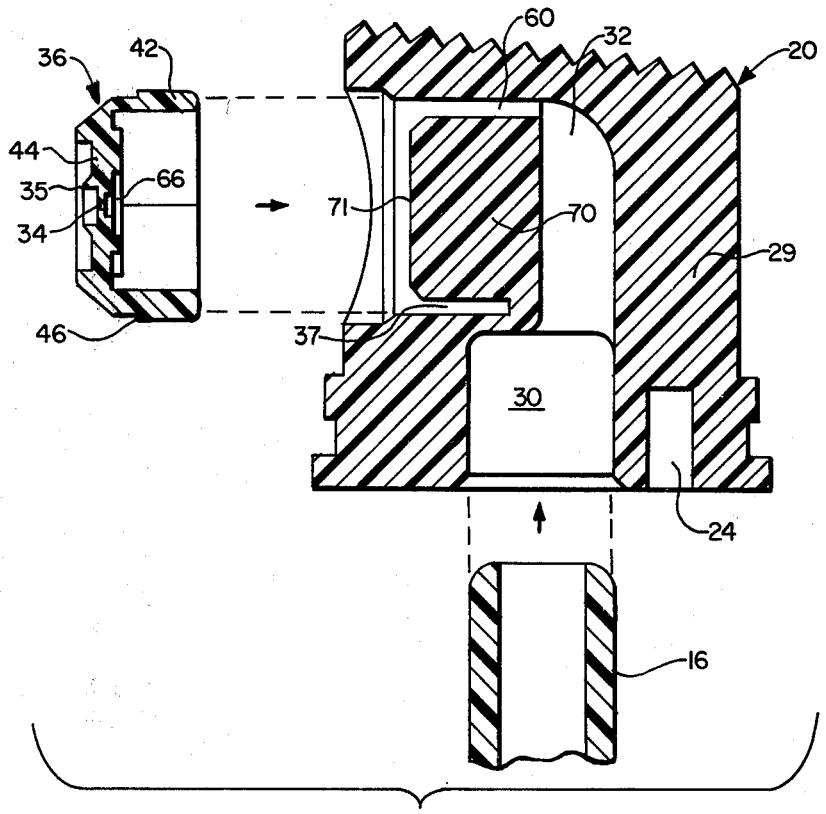
Figure 4:
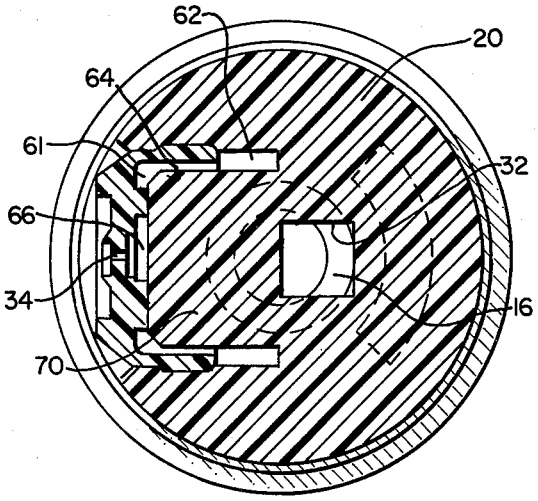
Figure 5:
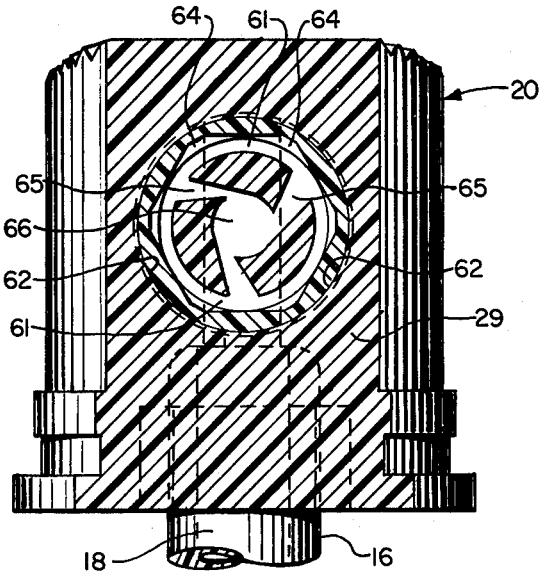
Figure 6:
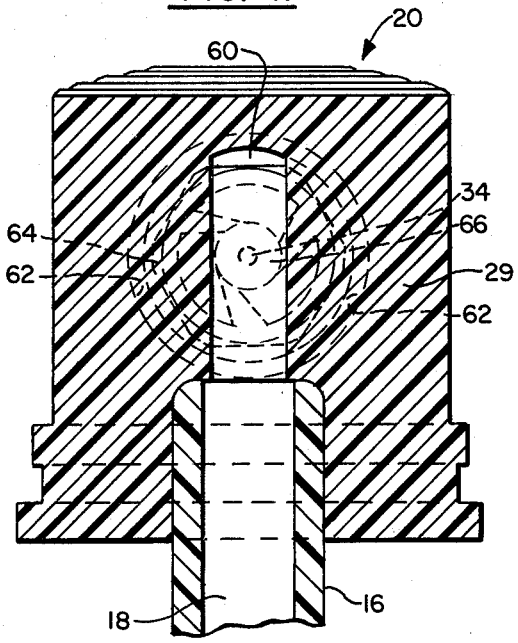
Figure 7:
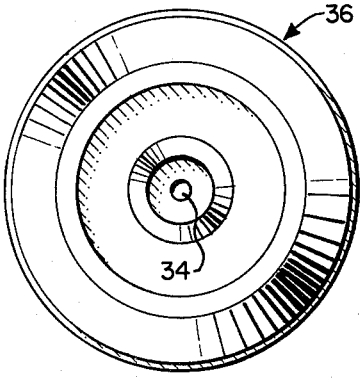
Figure 8:
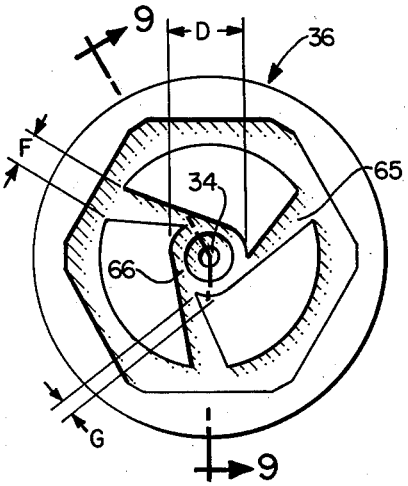
Figure 9:
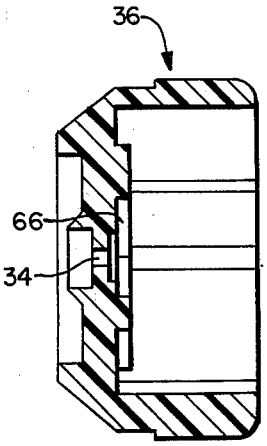

The invention will be more fully understood by reference to the drawings in which FIG. 1 - is a front elevational view of the tip and insert assembly of the present invention with stem attached, FIG. 2 - is an enlarged, partly sectional elevational view of the tip and stem of the present invention, FIG. 3 - is an exploded cross-sectional view of the tip, stem and insert of the present invention, FIG. 4 - is an enlarged cross-sectional view taken along line 4—4 of FIG. 2, FIG. 5 - is an enlarged, cross-sectional, elevational view taken along lines 5—5 of FIG. 2, FIG. 6 - is an enlarged, cross-sectional view taken along lines 6—6 of FIG. 2, FIG. 7 - is a front view of the insert of the present invention, FIG. 8 - is a rear view of the insert of the present invention, FIG. 9 - is a cross-sectional view taken along lines 9—9 of FIG. 8.

Figure 10:
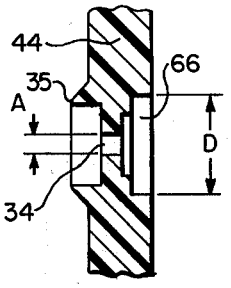

FIG 10 - is an enlarged cross-sectional view of the orifice of the insert of the present invention.

Referring now to the drawings, and in particular to FIGS. 1–3, tip 20 is a generally cylindrically shaped member adapted to carry an insert 36 having an exit orifice 34 therein. Tip 20 is mounted on a hollow discharge stem 16 of the type commonly provided on small hand-held dispensers. The discharge stem 16 may, for example, be a valve stem of a pump-type dispenser which utilizes a piston and cylinder action to effect the discharge. However, in the most preferred embodiment, discharge stem 16 is attached to an aerosol pressurized dispenser such as an aerosol container. As can be seen in FIGS. 2 and 3, discharge stem 16 is force-fitted into a discharge bore 30 of tip 20 which also serves as the initial discharge passage.

On the side of tip 20 is an annular recess 37 surrounding post 70 which is adapted to frictionally receive and seize the insert 36. Recess 37 has connected therewith a horizontal channel or connecting passage 60 which in turn communicates with the central bore 32 of tip 20. The post 70 of the tip 20 which is surrounded by the annular recess 37 is plug-like and has a front face 71 which is flat, vertical and circular when viewed from the direction indicated by the arrow in FIG. 3. The tip 20 may be readily molded of a plastic material, either thermoplastic or thermosetting, and to facilitate placing of the insert it has the usual annular coring or recess 24 and stop rib.

In accordance with the present invention, the insert 36 is cup-shaped and constructed in a unique manner by which, in cooperation with the adjoining post 70 and face 71 provides a desirable swirl and breaking up of the stream of substance which is being discharged through the tip, thereby to effect a fine atomizing spray, the insert being economically moldable of plastic material and securely retained on the post 70.

The insert 36 has an annular or cylindrical sidewall 42 which is press-fitted in annular recess 37 of the tip 20. Side-wall 42 has an annular step 46 thereon which snugly engages and holds the outer walls of recess 37 when insert 36 is force-fitted onto post 70. Insert 36, as best seen in FIGS. 3 and 7, has a front wall 44 having connected on the outer face thereof sharp edge 35 which eliminates build-up of spray particles. In the interior of sharp edge 35 is located discharge orifice 34 which is a generally circular, cylindrical hole running through insert 36 through which spray exits from the insert.

The inside (or backside) of insert 36 can be best seen by reference to FIG. 8 and FIG. 9. The inside preferably has a hexagonal cross-section. The corners of the hexagonal cross-section in conjunction with tip post 70 form longitudinal channels 64 for conveying fluids from passage 60 to orifice 34. A pentagonal, heptagonal, or octagonal cross-section could be used.

For imparting a swirling movement to the substance being discharged, and to produce a desirable atomizing spray and pattern, the inside surface of front wall 44 of insert 36 has a plurality of tapered feed channels 65 connecting tangentially with a common central recess or swirl chamber 66 at their inner ends. The tapered feed channels 65 also directly communicate with generally circular channel 61 and longitudinal channel 64, best seen in FIGS. 4 and 5. Upon tip 20 being depressed, the substance which is discharged upward through stem 16 and central bore 32 will be led through connecting channel 60 from which it will pass into an inner, circular, cylindrical chamber 62, chamber 62 being the portion of annular recess 37 remaining after insert 36 is in place. From chamber 62 it will pass through longitudinal channels 64 and into the generally cylindrical chamber 61 which acts as a distribution manifold. As can be seen in FIG. 5, each one of the longitudinal channels 64 are positioned so that a major portion of each of the channels 64 is positioned between two of the entrance ends of the tapered feed channels 65. From such manifold the substance passes through the tapered channel 65 and swirls into the swirl chamber 66 from which it passes through discharge opening 34 to emerge as a fine, swirling spray. The tangential relationship between the tapered channel 65 and swirling chamber 66 impart a powerful swirling action to the substance being discharged.

To achieve the desirable spray characteristics of the tip of the present invention, several parameters are important. In FIG. 10, the diameter of the orifice is listed as dimension A and the diameter of the swirl chamber 66 is listed as dimension D. The diameter of the orifice 34 should be equal to from about 1/5 to about ½ of the diameter of the swirl chamber, i.e., A:D varies from about 1:4 to about 1:5.

In FIG. 8, the width of the entrance end to tapered channels 65 is indicated by the letter F and the width of the exit end of tapered channels 65 is indicated by the letter G. The ratio of G:F should vary from about ¼ to about ¾, or more preferably, from about 2/5 to about 3/5.

What is claimed is:

1. An aerosol valve tip and insert assembly which produces a fine, efficient spray over a broad pressure range comprising:

a. a tip member means having:

i. a central discharge bore means adapted to frictionally fit the discharge stem of a dispenser, ii. an annular side recess means, iii. a connecting passage means communicating with said bore and said recess means, iv. a cylindrical post means having a generally flat, circular front face, said cylindrical post means being encircled by said annular side recess means, and b. cup-shaped insert means adapted to be frictionally fitted onto said cylindrical post means, said insert means having:

i. a transverse front wall provided with a central discharge opening means, the inside surface of said front wall having a central circular swirl chamber means communicating with said central discharge opening means, and a plurality of tapered channel means extending outwardly from said swirl chamber means, said tapered channel means being tapered toward said swirl chamber means, said tapered channel means connecting said swirl chamber means with cylindrical manifold means, and ii. a plurality of interconnected equilateral side walls perpendicular to said front wall which form a polygon and which fit into said annular side recess to form a plurality of longitudinal channel means for conveying fluids from said central discharge bore means to said cylindrical manifold means, each of said longitudinal channel means being positioned so that a major portion of said longitudinal channel means lies between two of said entrance ends of said plurality of tapered channels, the diameter of said discharge opening means being equal to from about 1/5 to about ½ of the diameter of said swirl chamber means, and the ratio of the width of the exit end of said tapered channels to the entrance end of said tapered channels varies from about ¼ to about ¾.

2. The apparatus of claim 1 wherein the ratio of the width of the exit end of said tapered channels to the entrance end of said tapered channels varies from about 2/5 to about 3/5.

3. The apparatus of claim 1 wherein said transverse front wall of said cup-shaped insert means has means for eliminating build-up of spray particles on the outside of said transverse front wall.

4. The apparatus of claim 3 wherein said means for eliminating build-up of spray particles comprises a circular, sharp edge which surrounds said central discharge opening means.

5. The apparatus of claim 1 wherein the diameter of said discharge opening means is equal to from about ¼ to about 2/5 of the diameter of said swirl chamber means.

* * * * *